US008672712B2

(12) United States Patent
Matsuoka

(10) Patent No.: US 8,672,712 B2
(45) Date of Patent: Mar. 18, 2014

(54) SHIELD AND CIRCUIT BOARD MODULE HAVING THE SAME

(75) Inventor: Kimihiro Matsuoka, Kasugai (JP)

(73) Assignee: DENSO CORPORATION, Kariya (JP)

( * ) Notice: Subject to any disclaimer, the term of this patent is extended or adjusted under 35 U.S.C. 154(b) by 43 days.

(21) Appl. No.: 13/450,569

(22) Filed: Apr. 19, 2012

(65) Prior Publication Data

US 2012/0276757 A1 Nov. 1, 2012

(30) Foreign Application Priority Data

Apr. 27, 2011 (JP) ..... 2011-99506

(51) Int. Cl.
*H01R 13/648* (2006.01)

(52) U.S. Cl.
USPC ..... 439/607.4

(58) Field of Classification Search
USPC ..... 439/79, 607.35–607.4
See application file for complete search history.

(56) References Cited

U.S. PATENT DOCUMENTS

| | | | | |
|---|---|---|---|---|
| 6,343,956 | B2 * | 2/2002 | Stickney | 439/607.17 |
| 7,686,646 | B2 * | 3/2010 | Lee et al. | 439/567 |
| 7,708,600 | B2 * | 5/2010 | Wu | 439/660 |
| 7,901,221 | B1 * | 3/2011 | Li et al. | 439/95 |

FOREIGN PATENT DOCUMENTS

| | | |
|---|---|---|
| JP | A-H06-26174 | 4/1994 |
| JP | U-3122531 | 6/2006 |
| JP | A-2006-286216 | 10/2006 |
| JP | A-2009-266495 | 11/2009 |

OTHER PUBLICATIONS

Office Action mailed Feb. 19, 2013 in corresponding JP Application No. 2011-099506 (and English translation).

* cited by examiner

*Primary Examiner* — Phuong Dinh

(74) *Attorney, Agent, or Firm* — Posz Law Group, PLC

(57) ABSTRACT

A shield is made of a conductive material and used to cover a connector fixed to a circuit board. The shield includes a shield body, a contact portion and a lock portion. The shield body covers an outside of the connector. The contact portion projects from the shield body toward inside of the shield body to contact a ground terminal of the connector. The contact portion is elastically deformable and applies a pressing force toward the connector. The lock portion projects from the shield body toward outside of the shield body. The lock portion is brought into contact with the connector by a reaction force exerted to the shield body due to the pressing force, thereby to restrict the shield body from being moved relative to the connector due to the reaction force.

8 Claims, 8 Drawing Sheets

SHIELD AND CIRCUIT BOARD MODULE HAVING THE SAME

CROSS REFERENCE TO RELATED APPLICATION

This application is based on Japanese Patent Application No. 2011-99506 filed on Apr. 27, 2011, the disclosure of which is incorporated herein by reference.

TECHNICAL FIELD

The present disclosure relates to a shield that is made of a conductive material and used to reduce noise, and a circuit board module having the shield.

BACKGROUND

It has been known to cover a connector that provides electric connection in an electric and electronic device with a shield made of a conductive material. Because the shield electromagnetically covers the connector, the influence of noise on a periphery of the connector can be reduced. Such a shield is, for example, described in JP2006-286216A.

FIG. 9 illustrates an example of a shield covering a connector. As shown in FIG. 9, a shield 101 has a contact portion 103 to make electric connection with a ground terminal 102 of a connector 100. The contact portion 103 project inwardly from a shield body 104 and is elastically deformable. The contact portion 103 is in contact with the ground terminal 102 of the connector 100 by means of elastic deformation, that is, a spring force thereof.

In the above example utilizing the spring force of the contact portion 103, the contact portion 103 applies a pressing force in a direction F1 to the ground terminal 102, as shown in FIG. 10. With this, a reaction force in a direction F2 opposite to the direction F1 of the pressing force is applied to the shield 101. Therefore, the shield 101 receives a force in a clockwise direction of FIG. 10 due to the reaction force. When the shield 101 is placed on the connector 100 during assembling, the shield 101 is easily separated from the connector 100. Therefore, it is necessary to hold the shield 101 using a jig or the like on the connector 100, such as by pressing a top portion 106 of the shield 101 against the connector 100, before the shield 101 is fixed to a circuit board 105.

SUMMARY

It is an object of the present disclosure to provide a shield that can be held on a connector without requiring a jig or the like after being placed on the connector and before being fixed to a circuit board. It is another object of the present disclosure to provide a circuit board module having the shield.

According to an aspect, a shield is made of a conductive material and used to cover a connector fixed to a circuit board. The shield includes a shield body, a contact portion and a lock portion. The shield body covers an outside of the connector. The contact portion projects from the shield body toward inside of the shield body to contact a ground terminal of the connector. The contact portion is elastically deformable and applies a pressing force toward the connector. The lock portion projects from the shield body toward outside of the shield body. The lock portion is brought into contact with the connector by a reaction force exerted to the shield body due to the pressing force, thereby to restrict the shield body from being moved relative to the connector due to the reaction force.

In the above structure, even if the shield body receives the reaction force of the pressing force, the shield and the connector are held in a preliminarily fixed state. Therefore, the shield can be held on the circuit board without requiring support by a jig or the like, before the shield is fixed to the circuit board.

According to another aspect, a circuit board module includes a circuit board, a connector, and a shield. The connector is mounted on the circuit board. The connector has a ground terminal and a stopper portion. The shield is disposed on the connector. The shield includes a shield body, a contact portion, and a lock portion. The shield body is made of a conductive material, and covers the connector. The contact portion is elastically deformable and contacts the ground terminal of the connector while applying a pressing force against the ground terminal. The lock portion projects outwardly from the shield body and is opposed to the stopper portion of the connector. The lock portion is brought into contact with the stopper portion when a reaction force of the pressing force is exerted to the shield body thereby to restrict the shield body from being moved relative to the connector due to the reaction force.

In the above structure, even if the shield body receives the reaction force of the pressing force, the shield and the connector are held in a preliminarily fixed state. Therefore, the shield can be held on the circuit board without requiring support by a jig or the like, before the shield is fixed to the circuit board.

BRIEF DESCRIPTION OF THE DRAWINGS

The above and other objects, features and advantages of the present disclosure will become more apparent from the following detailed description made with reference to the accompanying drawings, in which like parts are designated by like reference numbers and in which.

DETAILED DESCRIPTION

Hereinafter, an embodiment will be described with reference to FIGS. 1 through 8.

Figure 1:
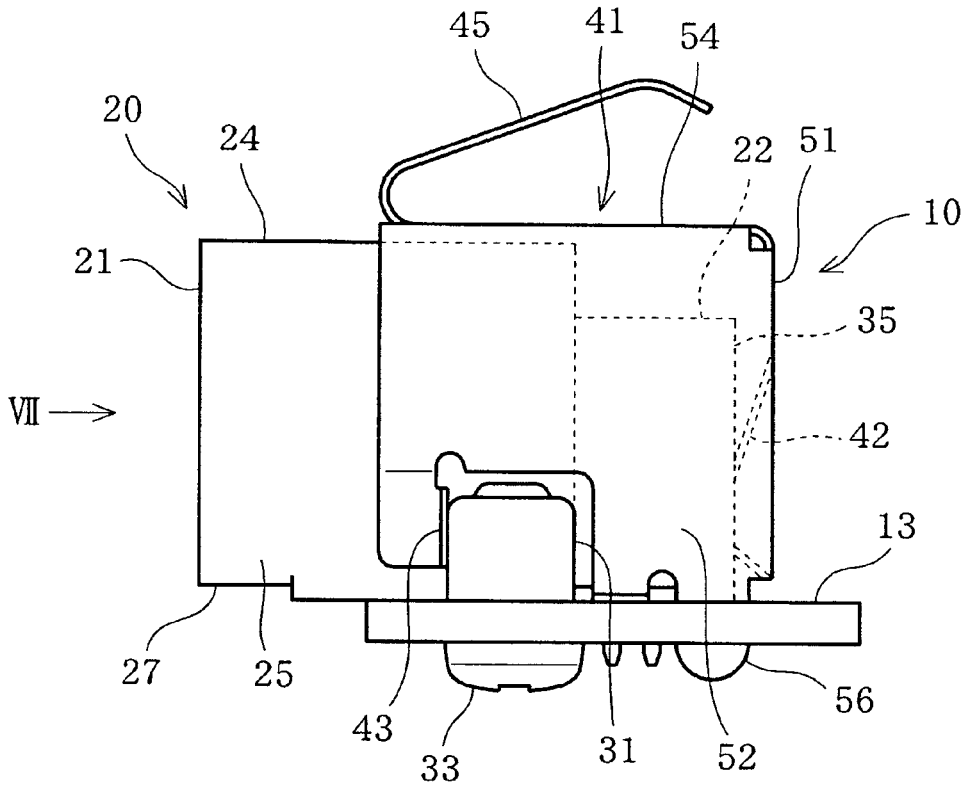
FIG. 1 is a diagram illustrating a side view of a connector and a shield attached to the connector according to an embodiment.
Figure 2:
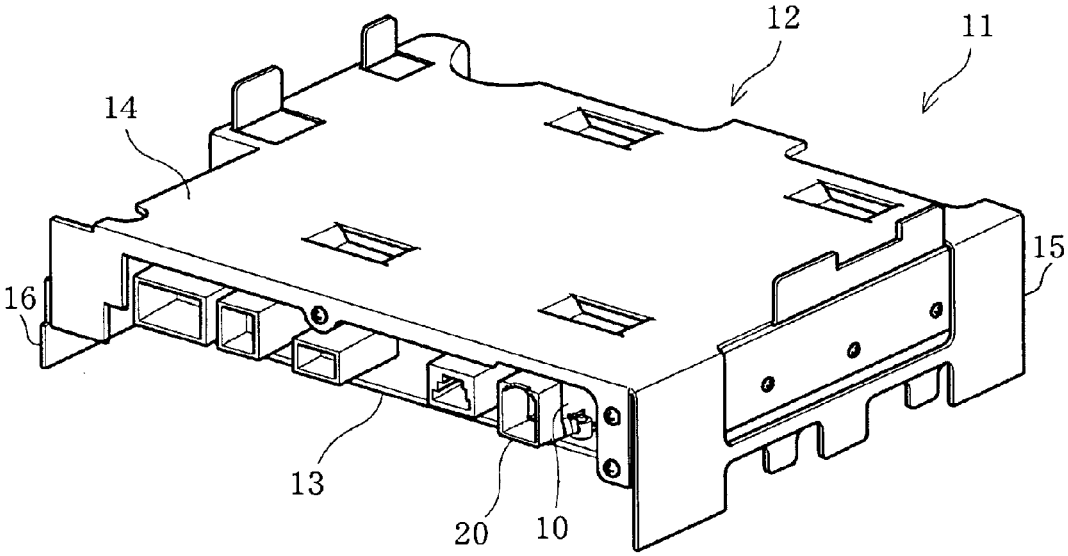
FIG. 2 is a diagram illustrating an oblique perspective view of a circuit board module employing the shield according to the embodiment.

Referring to FIGS. 1 and 2, a shield 10 is employed in a circuit board module 11. The circuit board module 11 is, for example, employed in a navigation apparatus.

The circuit board module 11 includes a metal frame 12 and a circuit board 13. The circuit board 13 is supported by the frame 12. The frame 12 is made of a conductive material, such as a metal. The frame 12 generally has a frame upper portion 14, a frame first side portion 15 and a frame second side portion 16. The frame first side portion 15 and the frame second side portion 16 extend from opposite ends of the frame upper portion 14. The frame first side portion 15 and the frame second side portion 16 are integral with the frame upper portion 14. The circuit board 13 is supported between the frame first side portion 15 and the frame second side portion 16.

Hereinafter, a side corresponding to a top side in FIG. 2 is referred to as a top side of the circuit board module 11, and a side corresponding to a bottom side in FIG. 2 is referred to as a bottom side of the circuit board module 11 for the purpose of convenience of explanation. The top side and the bottom side do not necessarily relate to directions where the circuit board module 11 is actually used.

Various elements constituting the circuit board module 11 are mounted on the circuit board 13. Also, wirings connecting between the elements are formed in the circuit board 13.

Figure 3:
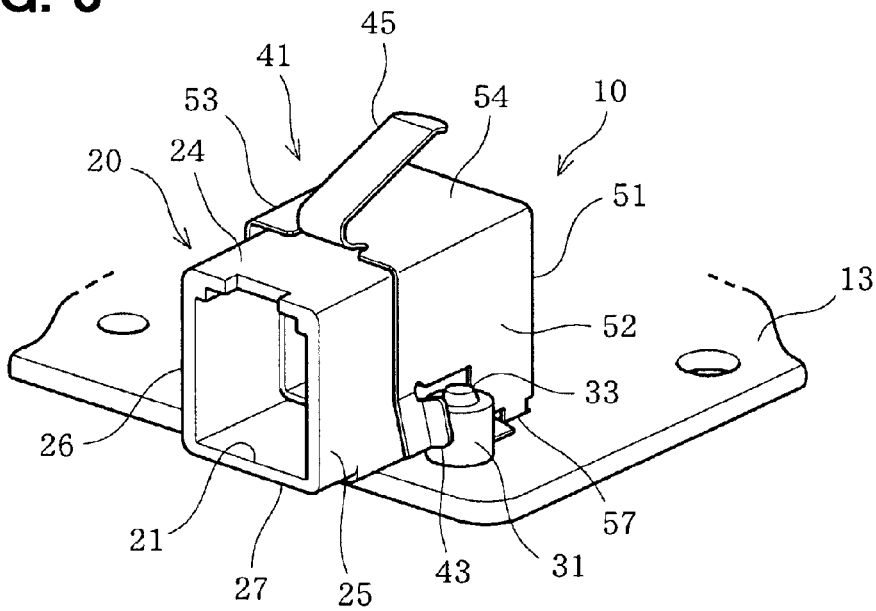
FIG. 3 is a diagram illustrating an oblique front perspective view of the shield attached to the connector according to the embodiment.
Figure 4:
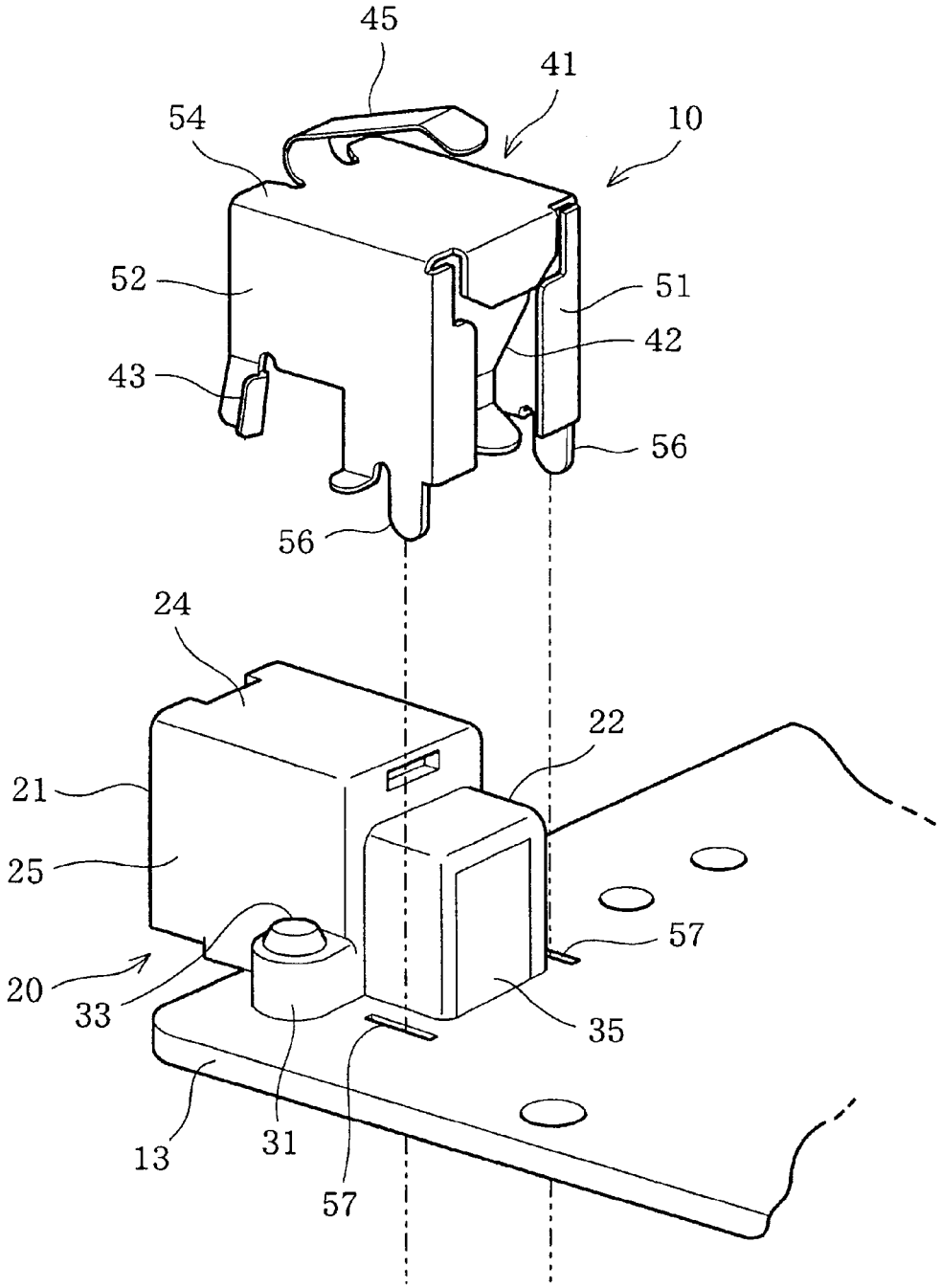
FIG. 4 is a diagram illustrating an exploded view of the shield and the connector, when viewed from an obliquely rear side, according to the embodiment.

The circuit board 13 has a connector 20 on a first surface, such as an upper surface facing the frame upper portion 14. As shown in FIGS. 1 and 3, the connector 20 has a rectangular tube shape having a closed end on one side. The connector 20 has an insertion opening 21 that opens in an axial direction at an end of the rectangular tube shape. The closed end of the connector 20 is disposed opposite to the insertion opening 21 with respect to the axial direction. The closed end is provided by an end wall 22.

Hereinafter, a side corresponding to the insertion opening 21 is referred to as a front side of the connector 20, and a side corresponding to the end wall 22 is referred to as a rear side for the purpose of convenience of explanation. Therefore, the end wall 22 is also referred to as the connector rear end wall 22.

To the insertion opening 21 of the connector 20, a coupler of a global positioning system (GPS) signal receiver is inserted. When the coupler is inserted to the insertion opening 21, the circuit board module 11 is connected to the GPS signal receiver and can receive the GPS signal.

The connector 20 is generally made of a resin. A conductive member such as a wiring portion is molded in the connector 20. For example, the connector 20 is made by insertion molding together with the conductive member. The connector 20, which has the rectangular tube shape, has a connector top wall 24, a connector first side wall 25, a connector second side wall 26 and a connector bottom wall 27. An outer surface of the connector bottom wall 27 is in contact with the circuit board 13.

Figure 5:
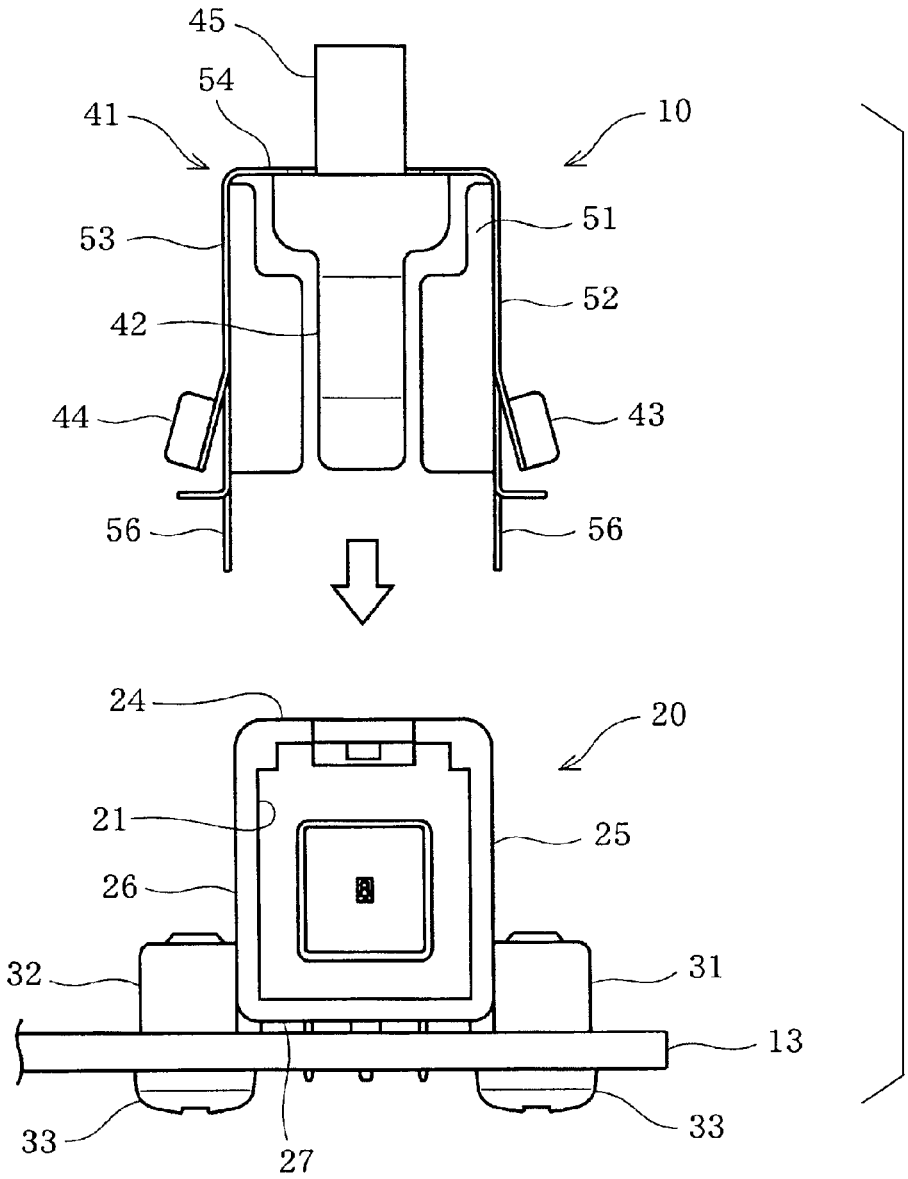
FIG. 5 is a diagram illustrating an exploded view of the shield and the connector, when viewed from a front side, according to the embodiment.

The connector first side wall 25 and the connector second side wall 26 extend from opposite ends of the connector top wall 24 and connect to opposite ends of the connector bottom wall 27. As shown in FIG. 5, the connector first side wall 25 and the connector second side wall 26 are formed with a first stopper portion (first fixing portion) 31 and a second stopper portion (second fixing portion) 32, respectively. The connector first side wall 25 and the connector second side wall 26 are opposed to each other with respect to a direction perpendicular to the axis of the tube shape of the connector 20.

The first stopper portion 31 projects from the connector first side wall 25 outside of the connector 20. The second stopper portion 32 projects from the connector second side wall 26 outside of the connector 20. The first stopper portion 31 has a curved surface at an end further from the connector first side wall 25. The second stopper portion 32 has a curved surface at an end further from the connector second side wall 26.

The connector 20 is fixed to the circuit board 13. For example, the connector 20 is fixed to the circuit board 13 by fixing members, such as screw members 33. The screw members 33 pass through the circuit board 13 and the first and second stopper portions 31, 32 in a direction substantially perpendicular to a plane of the circuit board 13, such as in an up and down direction of FIG. 3.

The connector 20 has a ground terminal 35 on an outer side of the connector rear end wall 22. The ground terminal 35 is provided by a conductive metal insert-molded in the connector 20. The ground terminal 35 is exposed from the connector rear end wall 22 to the outside of the connector 20.

Next, a structure of the shield 10 will be described in detail.

The shield 10 is made of a conductive material, such as a conductive metal. The shield 10 covers the connector 20 fixed to the circuit board 13 in the above described manner. As shown in FIGS. 1 and 5, the shield 10 has a shield body 41, a contact portion 42, a first lock portion 43, a second lock portion 44 and a projection 45.

The shield body 41 covers the outside of the connector 20. In the case where the connector 20 has the rectangular tube shape as described above, the shield body 41 covers the outside of the connector 20 except for the bottom end of the connector 20 facing the circuit board 13 and the end of the connector 20 forming the insertion opening 21.

Specifically, the shield body 41 includes a shield rear portion (shield rear wall) 51, a shield first side wall 52, a shield second side wall 53 and a shield top wall 54. The shield rear portion 51 is disposed at the outside of the rear end wall 22 of the connector 20. That is, the shield rear portion 51 is located at the outside of the end of the connector 20, the end being opposite to the insertion opening 21.

The shield first side wall 52 extends from an end of the shield rear portion 51 toward the insertion opening 21 of the connector 20 along an outer surface of the connector first side wall 25. The shield second side wall 53 extends from the opposite end of the shield rear portion 51 toward the insertion opening 21 of the connector 20 along an outer surface of the connector second side wall 26.

The shield top wall 54 extends from the shield rear portion 51 toward the insertion opening 21 of the connector 20 along an outer surface of the connector top wall 24, which is opposite to the circuit board 13. Opposite ends of the shield top wall 54 with respect to a widthwise direction (e.g., a left and right direction in FIG. 5) connect to the shield first side wall 52 and the shield second side wall 53.

Each of the shield first side wall 52 and the shield second side wall 53 has a nail portion 56 projecting toward the circuit board 13. The nail portions 56 are inserted in support holes 57 of the circuit board 13. As the nail portions 56 are inserted in the support holes 57, the shield 10 is preliminarily fixed to the circuit board 13.

Figure 6:
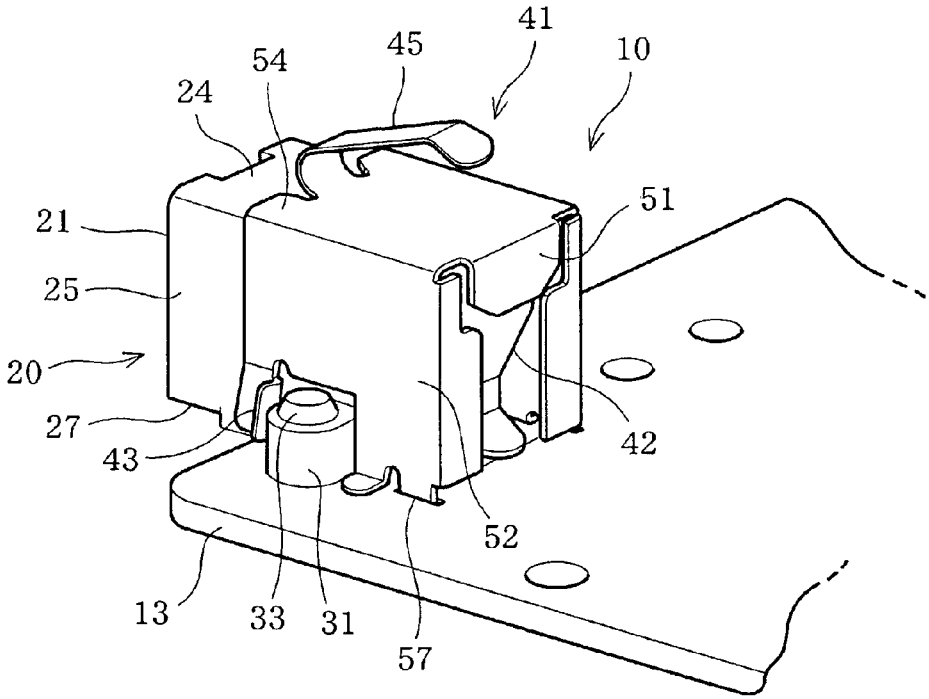
FIG. 6 is a diagram illustrating an oblique rear perspective view of the shield attached to the connector according to the embodiment.

As shown in FIGS. 1 and 6, the contact portion 42 is disposed in the shield rear portion 51. The contact portion 42 projects inside of the shield body 41, that is, toward the connector 20. The contact portion 42 is integrally formed with the shield body 41. The contact portion 42 is made of the conductive metal forming the shield body 41 and is elastically deformable.

The contact portion 42 is elastically deformable in a front and rear direction of the shield 10, such as in the left and right direction of FIG. 1. That is, the contact portion exerts a spring force in the front and rear direction of the shield 10. Therefore, when the shield 10 is attached to the connector 20, the contact portion 42 contacts the ground terminal 35 shown in FIG. 4, while applying a pressing force to the ground terminal 35, that is, to the connector 20.

Figure 7:
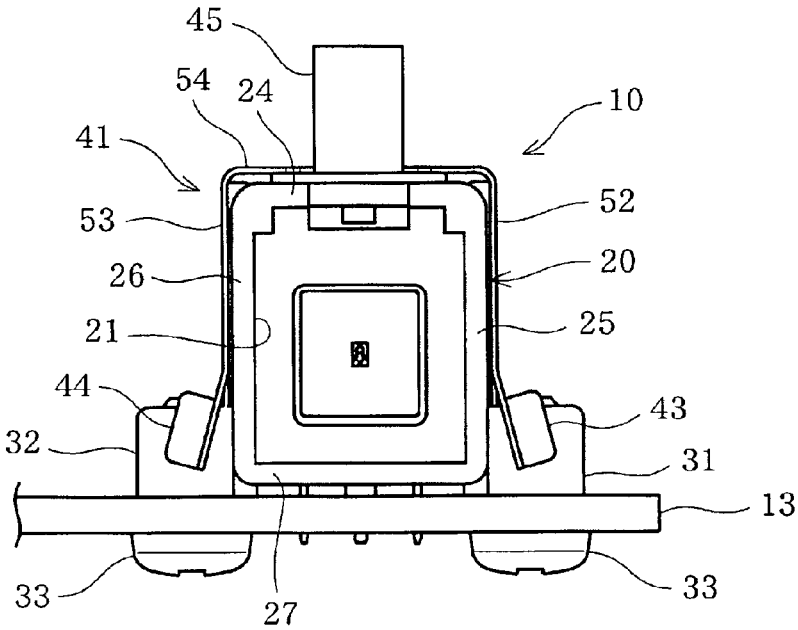
FIG. 7 is a diagram illustrating a front view of the shield attached to the connector, when viewed along an arrow VII in FIG. 1, according to the embodiment.

As shown in FIGS. 6 and 7, the first lock portion 43 is disposed in the shield first side wall 52. The second lock portion 44 is disposed in the shield second side wall 53. The first lock portion 43 projects from the shield first side wall 52 outside of the shield body 41. The second lock portion 44 projects from the shield second side wall 53 outside of the shield body 41.

In a state where the shield 10 is attached to the connector 20, as shown in FIGS. 6 and 7, the first lock portion 43 contacts a front end of the first stopper portion 31 of the connector 20, as shown in FIG. 1. Likewise, the second lock portion 44 contacts a front end of the second stopper portion 32 of the connector 20.

Further, in the state where the shield 10 is attached to the connector 20, the contact portion 42 of the shield body 41 presses against the ground terminal 35 toward the insertion opening 21, that is, in a frontward direction. Therefore, the shield 10 receives a reaction force in a rearward direction due to the pressing force applied by the contact portion 42.

The reaction force causes a relative movement between the shield 10 and the connector 20. Specifically, since the connector 20 is fixed to the circuit board 13, the shield 10 receives a force to move in the rearward direction relative to the connector 20 due to the reaction force caused by the pressing force of the contact portion 42. In such a state, the shield 10 is preliminarily fixed to the circuit board 13 as the nail portions 56 are received in the support holes 57 as described above. Therefore, the shield 10 tries to move in a clockwise direction of FIG. 1 about the nail portions 56 relative to the connector 20, that is, in the rearward direction.

In the present embodiment, the shield 10 has the first lock portion 43 and the second lock portion 44. Therefore, even if the shield 10 receives the force in the rearward direction relative to the connector 20, the movement of the shield 10 in the rearward direction is restricted due to the first lock portion 43 and the second lock portion 44 contacting the front ends of the first stopper portion 31 and the second stopper portion 32, respectively.

As such, even in a state where the contact portion 42 applies the pressing force to the ground terminal 35, the relative movement between the shield body 41 and the connector 20 is restricted. Accordingly, when the shield 10 is placed on the connector 20, that is, when the shield 10 is preliminarily fixed to the circuit board 13, the shield 10 can be independently held on the circuit board 13.

Figure 8:
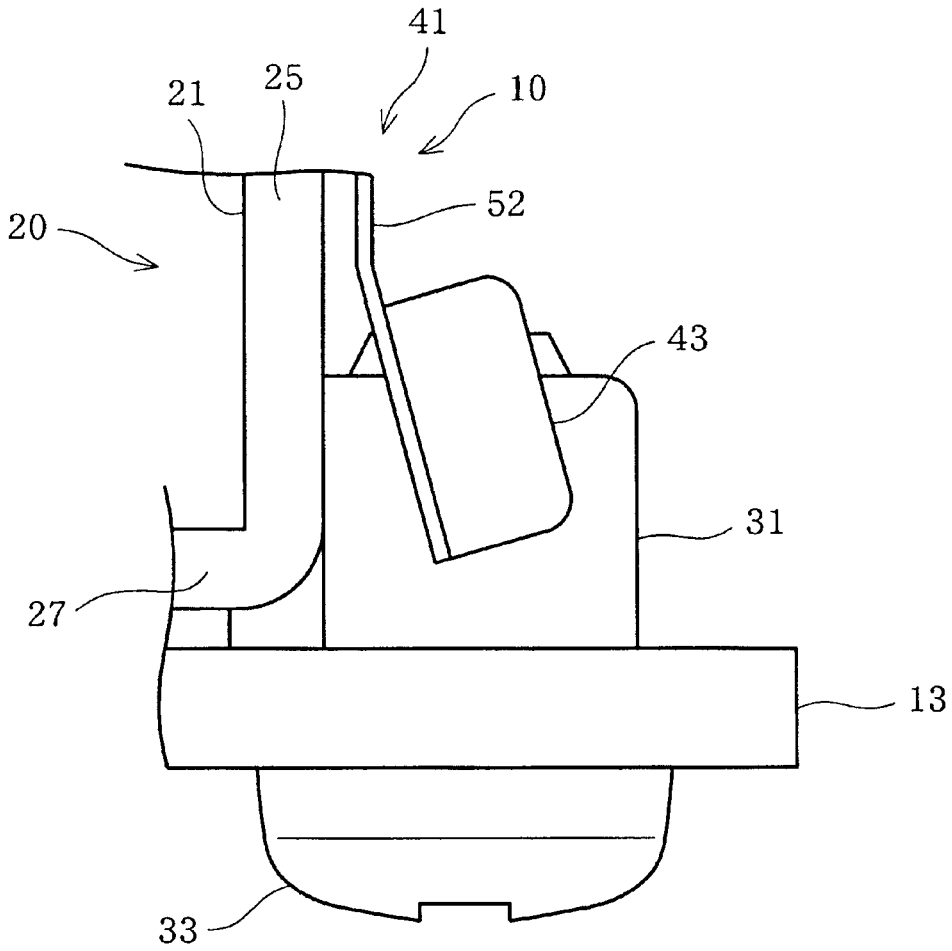
FIG. 8 is a diagram illustrating an enlarged view of a part of the shield shown in FIG. 7.
Figure 9:
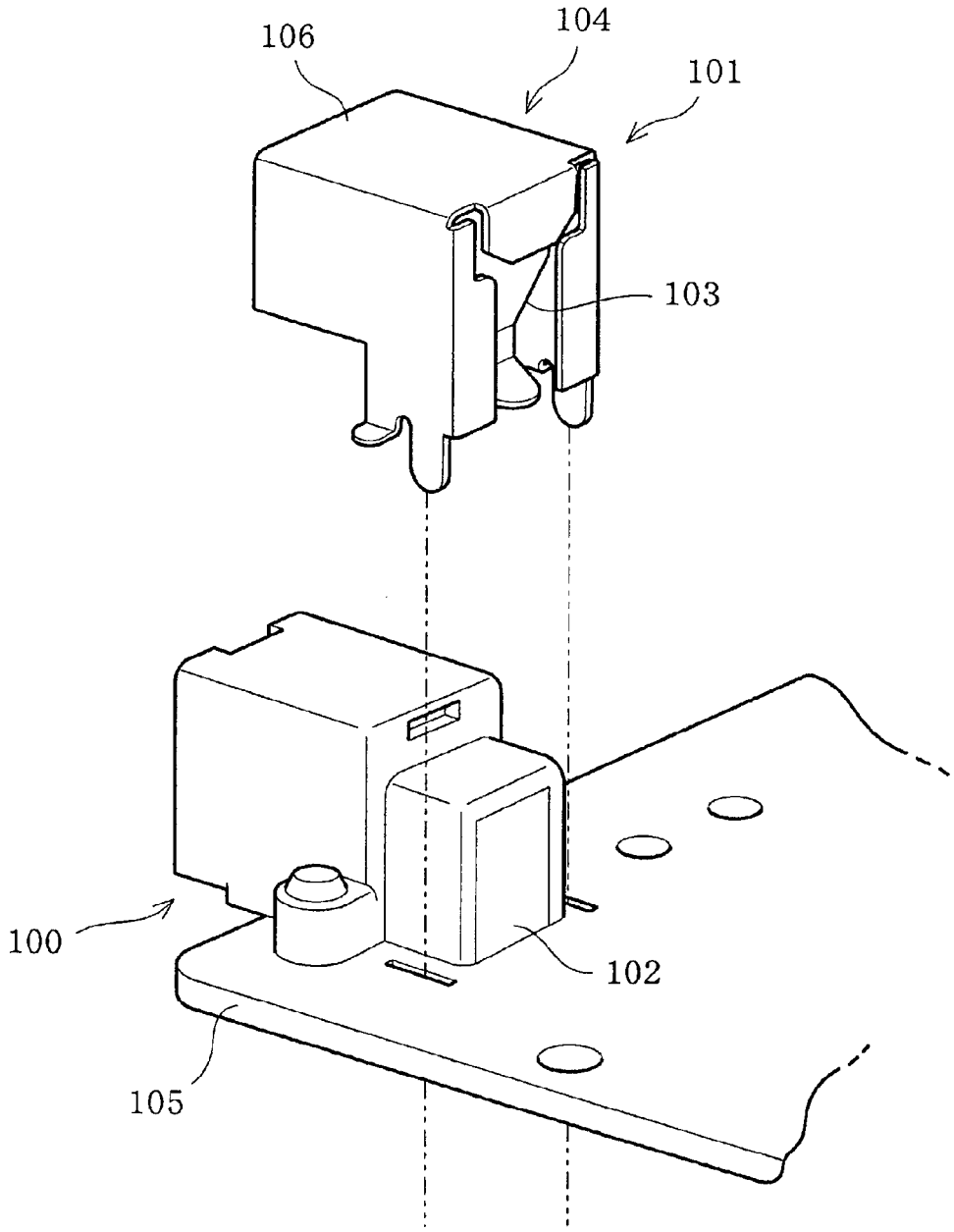
FIG. 9 RELATED ART
FIG. 9 is a diagram illustrating an exploded view of a shield and a connector according to a related art.
Figure 10:
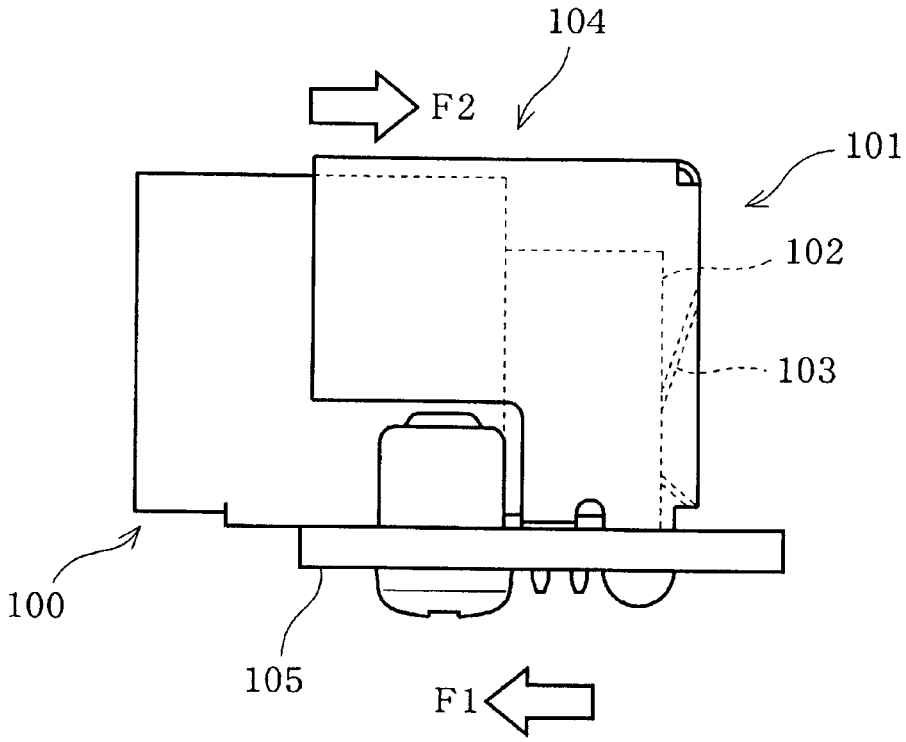
FIG. 10 RELATED ART
FIG. 10 is a diagram illustrating a side view of the shield attached to the connector according to the related art.

As shown in FIG. 8, the first lock portion 43 provides a clearance between a plane of the shield first side wall 52 and an inner surface of the first lock portion 43. The clearance increases toward the end adjacent to the circuit board 13. Namely, the first lock portion 43 is inclined relative to the plane of the shield first side wall 52. Likewise, the second lock portion 44 is inclined relative to a plane of the shield second side wall 53 so that a clearance between the plane of the shield second side wall 53 and an inner surface of the second lock portion 44 increases toward the end adjacent to the circuit board 13.

Since the first lock portion 43 and the second lock portion 44 are inclined as described above, it is less likely that the front end of the shield 10 adjacent to the circuit board 13 will contact the connector 20 when the shield 10 is attached to the connector 20. As such, the interference between the shield 10 and the connector 20 is reduced when the shield 10 is attached to the connector 20. Accordingly, the shield 10 is smoothly attached to the connector 20.

In order to reduce interference between the shield 10 and the circuit board 13 considering individual variability of the shield 10, it is necessary to provide a predetermined distance (clearance) between the end of the shield 10 and the circuit board 13. The function of restricting the movement of the shield 10 relative to the connector 20 when the shield 10 is attached to the connector 20 improves with an increase in contact area between the first stopper portion 31 and the first lock portion 43. That is, the relative movement between the shield 10 and the connector 20 is more restricted with the increase in the contact area between the first stopper portion 31 and the first lock portion 43.

In the structure where the predetermined distance is provided between the end of the shield 10 and the circuit board 13, if the first lock portion 43 is not inclined relative to the plane of the shield first side wall 52, it is difficult to ensure a sufficient contact area between the first stopper portion 31 and the first lock portion 43. That is, the length of a surface of the first lock portion 43 contacting the first stopper portion 31 in a direction of the shield first side wall 52 is limited. With this, the contact area is limited.

In the present embodiment, on the other hand, the first lock portion 43 is inclined. Therefore, a portion where the first lock portion 43 contacts the first stopper portion 31 is increased while maintaining the clearance between the end of the shield 10 and the circuit board 13 to a level substantially equal to the clearance where the first lock portion 43 is not inclined. As a result, the contact area between the first stopper portion 31 and the first lock portion 43 is increased greater than that when the first lock portion 43 is not inclined.

Even if the predetermined distance is provided between the end of the shield 10 and the circuit board 13, the contact area between the first stopper portion 31 and the first lock portion 43 is sufficiently ensured. Therefore, even if the reaction force is generated due to the contact between the contact portion 42 and the ground terminal 35, the relative movement of the shield 10 and the connector 20 is properly restricted.

Hereinabove, the contact between the first stopper portion 31 and the first lock portion 43 is explained. The second stopper portion 32 and the second lock portion 44 have the similar structures to the first stopper portion 31 and the first lock portion 43. Therefore, the contact area between the second stopper portion 32 and the second lock portion 44 is similarly ensured.

As shown in FIGS. 1, 3 and 7, the projection 45 is disposed in the top wall 54 of the shield body 41. The projection 45 projects from the shield top wall 54 in a direction substantially opposite to the circuit board 13, such as in a substantially upward direction. The projection 45 is integrally formed with the shield body 41, similar to the contact portion. The projection 45 is made of the conductive metal forming the shield body 41. The projection 45 is elastically deformable, and exerts a spring force.

As shown in FIG. 2, when the circuit board 13 to which the shield 10 has been attached to cover the connector 20 is fixed to the frame 12, the projection 45 contacts the frame 12. As a result, the ground terminal 35 of the connector 20 is electrically connected to the frame 12 through the contact portion 42 and the projection 45, which are made of the conductive metal.

In the present embodiment, the first stopper portion 31 and the second stopper portion 32 contact the first lock portion 43 and the second lock portion 44, respectively. Therefore, the shield 10 can be independently held on the circuit board 13 when the shield 10 is preliminarily fixed to the circuit board 13. In other words, when the shield 10 is attached to the connector 20, it is not necessary to hold the shield top wall 54 against the circuit board 13 by a jig or the like.

Since the jig or the like is not necessary, even if the shield 10 has the projection 45, interference with other parts and/or manufacturing apparatus is restricted. In other words, since the shield 10 can stay on the circuit board 13 without requiring support by other parts or members in the preliminarily fixed state, the shield 10 can have the projection 45. As such, grounding between the connector 20 and the frame 12 is ensured, and thus noise can be further reduced, as compared with a conventional structure.

Next, fabrication of the shield 10 having the above described structure, and a fabrication procedure of the circuit board module 11 will be described.

First, the connector 20 is fixed to the circuit board 13. The connector 20 is fixed to the circuit board 13 using fixing members, such as the screw members 33. The screw members 33 are threaded into the first and second stopper portions 31, 32 of the connector 20 through the circuit board 13.

After the connector 20 is fixed to the circuit board 13, the shield 10 is attached to the outside of the connector 20. The shield 10 is attached to the connector 20 toward the circuit board 13, that is, placed from the top side of the connector 20, which is opposite to the circuit board 13. The nail portions 56 of the shield 10 are inserted into the support hole 57 of the circuit board 13.

As described above, since the first lock portion 43 and the second lock portion 44 are inclined relative to planes of the shield first side wall 52 and the shield second side wall 53, respectively, the interference between the shield 10 and the connector 20 is reduced. In addition, the predetermined distance is provided between each of the first and second lock portions 43, 44 and the circuit board 13. Therefore, the interference between the shield 10 and the circuit board 13 is also reduced.

When the shield 10 is attached to the connector 20, the contact portion 42 of the shield 10 is brought into contact with the ground terminal 35 of the connector 20. Further, the first lock portion 43 of the shield 10 is brought into contact with the front end of the first stopper portion 31. Likewise, the second lock portion 44 of the shield 10 is brought into contact with the front end of the second stopper portion 32.

Therefore, even if the reaction force is applied to the shield 10 due to the contact between the elastically deformable contact portion 42 and the ground terminal 35, the movement of the shield 10 relative to the connector 20 is restricted by the contact between the first lock portion 43 and the first stopper portion 31 and the contact between the second lock portion 44 and the second stopper portion 32. As a result, even in the structure where the contact portion 42 exerts the pressing force to the ground terminal 35 of the connector 20, the shield 10 is properly preliminarily fixed to the circuit board 13 without being slipped out from the connector 20.

After the shield 10 is placed on the connector 20, the shield 10 is fixed to the circuit board 13. Specifically, the nail portions 56 of the shield 10, which project from the support holes 57 of the circuit board 13, are bonded to the circuit board 13, such as by a solder. As such, the shield 10 is fixed to the circuit board 13.

The circuit board 13 to which the shield 10 has been fixed is attached to the frame 12, as shown in FIG. 2. In this case, the projection 45 projecting from the top wall 54 of the shield 10 is in contact with the frame 12. Therefore, the shield 10 and the frame 12 are grounded to each other, and the ground terminal 35 of the connector 20 is electrically connected to the frame 12. In this way, the connector 20 is grounded to the frame 12.

As described above, the shield 10 according to the present embodiment has the first lock portion 43 and the second lock portion 44 projecting outside of the shield body 41. The first lock portion 43 and the second lock portion 44 contact the first stopper portion 31 and the second stopper portion 32 of the connector 20, respectively, when the shield body 41 receives the reaction force due to the contact between the ground terminal 35 and the contact portion 42.

As such, the first lock portion 43 and the second lock portion 44 restrict the movement of the shield body 41 relative to the connector 20. Accordingly, even if the reaction force due to the pressing force exerted to the ground terminal 35 by the contact portion 42 is applied to the shield body 41, the connector 20 and the shield body 41 are held in a preliminarily fixed state. Therefore, the shield 10 can be held on the circuit board 13 without requiring a jig or the like until the shield 10 is bonded to the circuit board 13 after being placed on the connector 20.

Further, the clearance provided between the first lock portion 43 and the plane of the shield first side wall 52 increases toward the end of the first lock portion 43 adjacent to the circuit board 13. Likewise, the clearance provided between the second lock portion 44 and the plane of the shield second side wall 53 increases toward the end of the second lock portion 44 adjacent to the circuit board 13. Namely, the first lock portion 43 and the second lock portion 44 are inclined relative to the shield body 41.

Since the first lock portion 43 is inclined relative to the shield body 41, the contact area between the first lock portion 43 and the first stopper portion 31 of the connector 20 can be increased, while maintaining the distance (clearance) between the end of the first lock portion 43 and the circuit board 13 to the substantially same distance as that when the first lock portion 43 is not inclined. Likewise, since the second lock portion 44 is inclined relative to the shield body 41, the contact area between the second lock portion 44 and the second stopper portion 32 of the connector 20 can be increased.

As such, even if a space is limited in the circuit board module 11, the contact area between the first lock portion 43 and the first stopper portion 31 and the contact area between the second lock portion 44 and the second stopper portion 32 are properly ensured. Accordingly, the relative movement between the shield body 41 and the connector 20 can be securely restricted by the contact between the first lock portion 43 and the first stopper portion 31 and the contact between the second lock portion 44 and the second stopper portion 32.

The first stopper portion 31 and the second stopper portion 32 are necessary parts for fixing the connector 20 to the circuit board 13. In other words, the first stopper portion 31 and the second stopper portion 32 are provided by the fixing portions that are necessarily employed to fix the connector 20 to the circuit board 13 through the screw members 33.

In the present embodiment, the first stopper portion 31 and the second stopper portion 32, which are used to fix the connector 20 to the circuit board 13, are also used as the stoppers for preliminarily fixing the shield 10. Therefore, it is not necessary to add parts/structures in the connector 20 for preliminarily fixing the shield 10. Namely, the existing portions can be effectively used without requiring the design change, and commonly used.

The shield 10 has the projection 45 at the top wall 54. The shield 10 is independently held on the connector 20 and the circuit board 13 without requiring the jig or the like. Since the jig for holding the shield 10 is not necessary, the shield 10 can have the projection 45 at the top wall 54. Therefore, the shield body 41 can have the electric contact with the frame 12 and the like other than the circuit board 13 through the projection 45. As such, the noise can be further reduced.

In the present embodiment, the first lock portion 43 is provided in the shield first side wall 52 and the second lock portion 44 is provided in the shield second side wall 53 opposite to the shield first side wall 52. That is, each of the side walls of the shield body 41 has the lock portion. The reaction force applied to the shield body 41 due to the contact between the contact portion 42 and the ground terminal 35 is received by the first lock portion 43 and the second lock portion 44 disposed at opposite sides of the shield body 41. Therefore, the position of the shield body 41 becomes stable, and the relative movement between the shield body 41 and the connector 20 is securely restricted.

The first stopper portion 31 is interposed between the first lock portion 43 and the shield body 41. The front end of the first stopper portion 31 can be held by the first lock portion 43, and the rear end of the first stopper portion 31 can be held by the shield body 41 such as the shield first side wall 52. Namely, a clearance between the shield body 41 and the rear end of the first stopper portion 31 is reduced so that a supplementary lock portion for supporting the lock by the first lock portion 43 is formed.

Therefore, even if a worker unintentionally contacts the shield 10 preliminarily fixed to the circuit board 13 during the preliminarily fixing or the like, the shield 10 is held at a proper position as the first lock portion 43 or the shield body 41 is received by the first lock portion 43. Accordingly, the shield 10 is held at a proper position relative to the connector 20.

Likewise, the second stopper portion 32 is interposed between the second lock portion 44 and the shield body 41. Therefore, the similar advantageous effect can be achieved.

Other Embodiments

The present disclosure is not limited to the above described embodiment, but may be implemented in various other ways without departing from the gist of the present disclosure.

In the above described embodiment, the first lock portion 43 and the second lock portion 44 are respectively provided at the shield first side wall 52 and the shield second side wall 53. Alternatively, the first lock portion 43 and the second lock portion 44 may be provided at other positions as long as the relative movement between the shield 10 and the connector 20 can be restricted. For example, the lock portions 43, 44 may be provided at the top wall 54 and/or the rear end wall 51. It is not always necessary that the shield 10 has the lock portions 43, 44 on both the first and second side walls 52, 53. For example, the lock portion may be provided at only one of the shield first side wall 52 and the shield second side wall 53.

In the above described embodiment, the connector 20 exemplarily has the rectangular tube shape and the shield 10 has the corresponding shape. However, the shape of the connector 20 is not limited to the rectangular tube shape. The connector 20 may have any other shape, such as a cylindrical tube shape or a polygonal tube shape. In such a case, the shape of the shield 10 may be changed according to the shape of the connector 20.

While only the selected example embodiment have been chosen to illustrate the present disclosure, it will be apparent to those skilled in the art from this disclosure that various changes and modifications can be made therein without departing from the scope of the disclosure as defined in the appended claims. Furthermore, the foregoing description of the example embodiment according to the present disclosure is provided for illustration only, and not for the purpose of limiting the disclosure as defined by the appended claims and their equivalents.

What is claimed is:

1. A shield made of a conductive material and used to cover a connector that has a stopper portion and is fixed to a circuit board, the shield comprising:

a shield body covering the connector;

a contact portion projecting from the shield body toward inside of the shield body to contact a ground terminal of the connector, the contact portion being elastically deformable and applying a pressing force toward the connector; and a lock portion projecting from the shield body toward outside of the shield body, the lock portion being brought into contact with the stopper portion of the connector by a reaction force exerted to the shield body due to the pressing force, thereby to restrict the shield body from being moved relative to the connector due to the reaction force, wherein the shield body includes an end wall, a first side wall, a second side wall and a top wall, the first side wall, the second side wall and the top wall extend from the end wall, the first side wall, the second side wall, the top wall and the end wall provide an opening to receive at least a portion of the connector, the contact portion is disposed at the end wall, the lock portion is disposed at an end of at least one of the first side wall and the second side wall to receive the stopper portion between the lock portion and the end of the at least one of the first side wall and the second side wall and to contact an end of the stopper portion opposite to the end wall of the shield body.

2. The shield according to claim 1, wherein the lock portion is inclined so that a distance from the shield body increases toward an end of the lock portion, the end being adjacent to the circuit board.

3. The shield according to claim 1, further comprising:

a projection projecting from a top wall of the shield body, the top wall being opposite to the circuit board, wherein the projection is elastically deformable.

4. The shield according to claim 2, wherein a clearance is provided between the circuit board and the end of the lock portion.

5. A circuit board module comprising:

a circuit board;

a connector mounted on the circuit board, the connector having a ground terminal and a stopper portion; and a shield disposed on the connector, the shield including a shield body, a contact portion, and a lock portion, the shield body being made of a conductive material and covering the connector, the contact portion being elastically deformable and contacting the ground terminal of the connector while applying a pressing force against the ground terminal, the lock portion projecting outwardly from the shield body and being opposed to the stopper portion of the connector, the lock portion being brought into contact with the stopper portion when a reaction force of the pressing force is exerted to the shield body, thereby to restrict the shield body from being moved relative to the connector due to the reaction force, wherein the shield body includes an end wall, a first side wall, a second side wall and a top wall, the first side wall, the second side wall and the top wall extending from the end wall and providing an opening in which at least a portion of the connector is received, the first side wall and the second side wall are opposed to each other, the top wall is opposed to the circuit board, the contact portion is disposed at the end wall, the lock portion is disposed at an end of at least one of the first side wall and the second side wall, the end being opposite to the end wall, and the stopper portion is disposed between the lock portion and the one of the first side wall and the second side wall.

6. The circuit board module according to claim 5, wherein the lock portion is inclined relative to a plane of the one of the first side wall and the second side wall so that a distance between the plane and the lock portion increases toward an end of the lock portion adjacent to the circuit board, and a clearance is provided between the circuit board and the end of the lock portion.

7. The circuit board module according to claim 5, wherein the shield further includes a projection projecting outside of the shield body from the top wall, the projection providing electric connection with an external member.

8. The circuit board module according to claim 5, wherein the connector has a fixing portion, and is fixed to the circuit board at the fixing portion, and the stopper portion is provided by the fixing portion.

* * * * *